US008242703B2

(12) United States Patent
Wang et al.

(10) Patent No.: US 8,242,703 B2
(45) Date of Patent: Aug. 14, 2012

(54) DRIVING APPARATUS FOR LIGHT EMITTING DIODES WITHOUT EMPLOYING ELECTROLYTIC CAPACITOR

(75) Inventors: Beibei Wang, Nan Jing (CN); Xinbo Ruan, Nan Jing (CN); Ming Xu, Nan Jing (CN); Kai Yao, Nan Jing (CN)

(73) Assignees: Nanjing University of Aeronautics and Astronautics, Jiangsu Province (CN); FSP Technology Inc., Taoyuan County (TW)

( * ) Notice: Subject to any disclaimer, the term of this patent is extended or adjusted under 35 U.S.C. 154(b) by 284 days.

(21) Appl. No.: 12/686,333

(22) Filed: Jan. 12, 2010

(65) Prior Publication Data

US 2011/0037414 A1 Feb. 17, 2011

Related U.S. Application Data

(60) Provisional application No. 61/233,833, filed on Aug. 14, 2009.

(51) Int. Cl.
*H05B 41/16* (2006.01)

(52) U.S. Cl. ..... 315/247; 315/185 S; 315/291; 315/307; 315/312

(58) Field of Classification Search ..... 315/247, 315/246, 224, 225, 274–279, 291, 307–311
See application file for complete search history.

(56) References Cited

U.S. PATENT DOCUMENTS

2008/0018261 A1* 1/2008 Kastner ..... 315/192
* cited by examiner

*Primary Examiner* — Tuyet Thi Vo
(74) *Attorney, Agent, or Firm* — Jianq Chyun IP Office

(57) ABSTRACT

A driving apparatus is provided and configured to suit driving at least a string of light emitting diodes (LEDs). The driving apparatus includes a flyback power factor correction (PFC) converter, a harmonics-filtering unit and a control unit. The flyback PFC converter works in an operation mode according to a pulse-width modulation (PWM) signal and receives an AC power so as to convert the AC power into a pulsating current. The harmonics-filtering unit is coupled to the flyback PFC converter and the string of LEDs, for receiving the pulsating current and filtering out the high-frequency harmonic components in the pulsating current so as to drive the string of LEDs. The control unit is coupled to the flyback PFC converter and the harmonics-filtering unit, for producing the PWM signal according to the AC power and the pulsating current, and reducing the peak-to-average ratio (PAR) of the pulsating current.

9 Claims, 7 Drawing Sheets

DRIVING APPARATUS FOR LIGHT EMITTING DIODES WITHOUT EMPLOYING ELECTROLYTIC CAPACITOR

CROSS-REFERENCE TO RELATED APPLICATION

This application claims the priority benefit of U.S. provisional application Ser. No. 61/233,833, filed on Aug. 14, 2009. The entirety of the above-mentioned patent application is hereby incorporated by reference herein and made a part of specification.

BACKGROUND OF THE INVENTION

1. Field of the Invention

The present invention generally relates to a driving apparatus for light emitting diodes (LEDs), and more particularly, to a driving apparatus for LEDs without employing an electrolytic capacitor.

2. Description of Related Art

Since the last 20 years, people have been keeping developing new types of illumination light sources. The European Union specifically worked out "Rainbow Project", wherein it is addressed that a new type light source must meet the following four conditions: high-efficiency, energy-saving, pollution-free and resembling natural light. In fact, LEDs have the above-mentioned advantages so that any traditional illumination light sources (for example, incandescent bulb and fluorescent lamp) are uncompetitive with the LEDs. In this regard, LEDs are commonly recognized as the "green" light source with the most value in the 21st century, and the LEDs would substitute the incandescent bulbs and fluorescent lamps to dominate the illumination product market.

In the present time, LEDs are mainly applicable to mega-size display, universal illumination, laser device, LCD backlight source, illumination for instrument and meter, and pattern identification and so on. Along with the rapid progress of high brightness LEDs, a more critical requirement must be fulfilled on the driving technique of LEDs, wherein in order to fully take advantage of the merit of the semiconductor illumination, the AC-DC driver for the LEDs needs to include the following advantageous: high efficiency, low cost, high power factor and long lifetime.

In terms of traditional LED driving, various schemes are available, such as current-limiting by using resistor, linear adjustment, charge pump converting control and switch converter control. With a daily illumination circumstance having a commercial AC (alternating current) voltage input, the AC-DC driver architecture for high power LEDs can be roughly shown by, for example, FIG. 1. According to the Energy-Star standard, the input power factor (IPF) of an AC-DC driver for commercial luminaries must be no less than 0.9, while the IPF of an AC-DC driver for residential luminaries, no less than 0.7. Accordingly, the commercial AC voltage Vac must be processed by a bridge-type rectifier 101 and a power factor correction converter 103 (PFC converter 103) so as to implement the PFC and the AC-DC converting to provide the DC-DC converter of the successive stage with a 24V or 12V stable voltage. In this way, the LED driving chip 107 is able to provide a constant current for stable operation of the large power LEDs 109.

Although the architecture of the AC-DC driver shown by FIG. 1 can ensure the large power LEDs 109 to have better light-emitting quality, but the above-mentioned design architecture comes with many disadvantages: too many components, larger volume and short lifetime. For example, assuming the IPF of the PFC converter 103 is 1, both the input current $I_{in}$ and the input voltage $V_{in}$ herein are sin-waves with the same phase as shown by FIG. 2A. Since the input power $P_{in}$ at the time takes sin-square waveform, to realize a constant-voltage and constant-current output (i.e., constant output power Po, as shown by FIG. 2B), an electrolytic capacitor C with a large capacitance is required so as to realize the balance between the input power $P_{in}$ and the output power $P_o$. It should be noted that the electrolytic capacitor C usually has a lifetime of 5,000 H (hour), which does not match the much longer lifetime of 50,000 H of the LEDs. It is obvious that the electrolytic capacitor C becomes the major factor to shorten the total lifetime of the LED AC-DC driver.

SUMMARY OF THE INVENTION

Accordingly, the present invention is directed to a driving apparatus configured to suit driving at least a string of LEDs, wherein a pulsating current is used to drive the high power LEDs so that not only a power factor correction is implemented, but also the electrolytic capacitor with a large capacitance in the traditional AC-DC driver architecture can be saved, which greatly increases the lifetime of the AC-DC driver for LEDs.

Other advantages of the present invention should be further indicated by the disclosures of the present invention, and omitted herein for simplicity.

To achieve one of, a part of or all of the above-mentioned advantages, or to achieve other advantages, the present invention provides a driving apparatus, which includes a flyback PFC converter, a harmonics-filtering unit and a control unit. The flyback PFC converter works in an operation mode according to a pulse-width modulation signal (PWM signal) and receives an AC power so as to convert the AC power into a pulsating current.

The harmonics-filtering unit is coupled to the flyback PFC converter and the string of LEDs for receiving the above-mentioned pulsating current and filtering out the high-frequency harmonic components in the pulsating current so as to drive the string of LEDs. The control unit is coupled to the flyback PFC converter and the harmonics-filtering unit and produces the PWM signal according to the AC power and the pulsating current, and reduces the peak-to-average ratio (PAR) of the pulsating current.

In an embodiment of the present invention, the above-mentioned flyback PFC converter includes a full-bridge rectifier, a transformer, a switch and a diode. The full-bridge rectifier receives the AC power and conducts a rectifying on the said AC power, wherein the primary side of the transformer receives the AC power after being rectified by the full-bridge rectifier. The switch is controlled by the PWM signal and connected in series to the primary side of the transformer. The diode is coupled to the secondary side of the transformer for outputting the said pulsating current.

In an embodiment of the present invention, the harmonics-filtering unit is composed by an inductor and a film capacitor.

In an embodiment of the present invention, the control unit includes a current transformer unit, a low-pass filter, an error-adjusting circuit, a first voltage-divider, a feedforward control unit and a pulse-width modulation control chip. The current transformer unit is coupled to the flyback PFC converter and the harmonics-filtering unit for detecting the said pulsating current. The low-pass filter is coupled to the current transformer unit for taking the average value of the detected pulsating current. The error-adjusting circuit is coupled to the low-pass filter for conducting an error adjusting on the pulsating current after taking the average value thereof and a reference current. The first voltage-divider is for sampling the AC power after being rectified by the full-bridge rectifier so as to produce a first voltage-dividing signal. The feedforward control unit is coupled to the error-adjusting circuit and the first voltage-divider for receiving the above-mentioned error adjusting signal and the first voltage-dividing signal so as to produce a control signal. The pulse-width modulation control chip is coupled to the feedforward control unit for receiving the control signal so as to produce the PWM signal. Under the above-mentioned condition, the flyback PFC converter works in discontinuous current mode (DCM).

In an embodiment of the present invention, the above-mentioned control unit includes a current transformer unit, a low-pass filter, an error-adjusting circuit, a chopping circuit, a multiplier and a current-adjusting circuit. The current transformer unit is coupled to the flyback PFC converter and the harmonics-filtering unit for detecting the pulsating current. The low-pass filter is coupled to the current transformer unit for taking the average value of the pulsating current detected after being detected by the current transformer unit. The error-adjusting circuit is coupled to the low-pass filter for conducting an error adjusting on the pulsating current after taking the average value thereof and a reference current so as to output an error adjusting signal. The chopping circuit is for receiving the AC power and conducting a chopping processing on the AC power so as to produce a chopped signal, wherein the AC power is rectified by the full-bridge rectifier already. The multiplier is coupled to the chopping circuit and the error-adjusting circuit for receiving the said chopped signal and the error adjusting signal so as to produce a first current. The current-adjusting circuit is coupled to the multiplier and the switch for conducting a current adjusting on the first current and a second current flowing through the switch so as to output the PWM signal. Under the above-mentioned condition, the flyback PFC converter works in boundary conduction mode (BCM).

Based on the depiction above, the driving apparatus provided by the present invention is suitable for driving LEDs with AC input, high power factor and long lifetime, wherein a pulsating current is used to drive the LEDs and the electrolytic capacitor in the traditional LED AC-DC driver circuit is eliminated, which greatly increase the lifetime of the LED AC-DC driver.

On the other hand, in addition to meeting the power factor requirement specified by the Energy-Star standard, the driving apparatus provided by the present invention is able to optimize the waveform of the pulsating current used to driving the LEDs by means of the harmonics-filtering unit and the control unit, and the optimized waveform would greatly reduce the PAR of the pulsating current output by the flyback PFC converter. In this way, the high power LEDs can stably, safely and durably work without affecting the operation lifetime of the LEDs.

In order to make the aforementioned and other features and advantages of the present invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
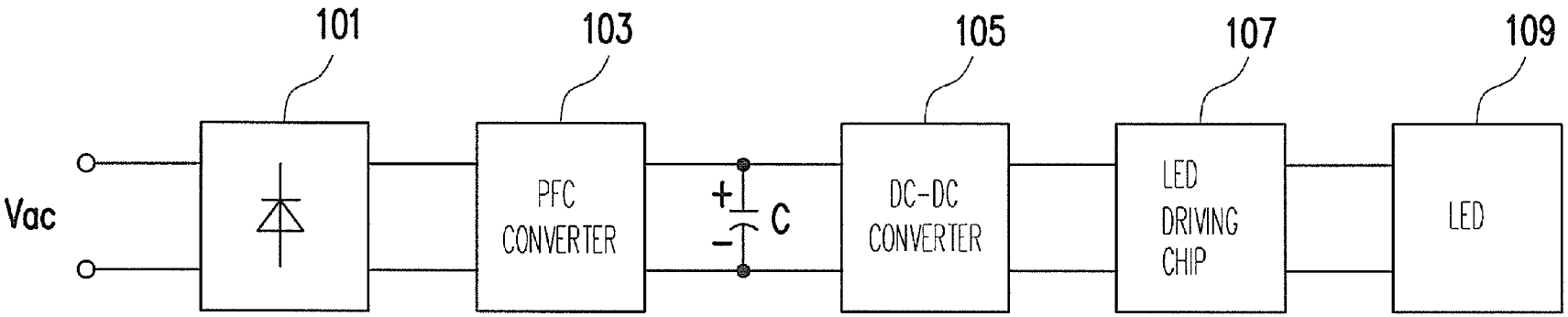
FIG. 1 (RELATED ART)
FIG. 1 is an architecture diagram of a traditional driving apparatus for LEDs.
Figure 2A:
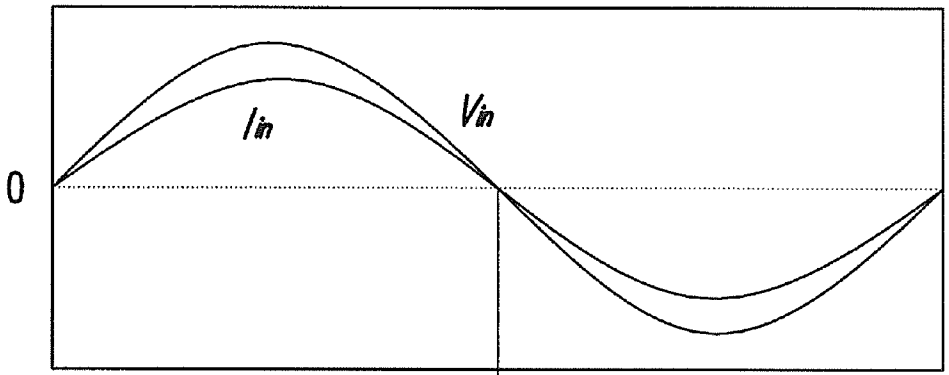
FIG. 2A(RELATED ART)
FIG. 2A is a diagram showing an input current and an input voltage with a traditional AC power.
Figure 2B:
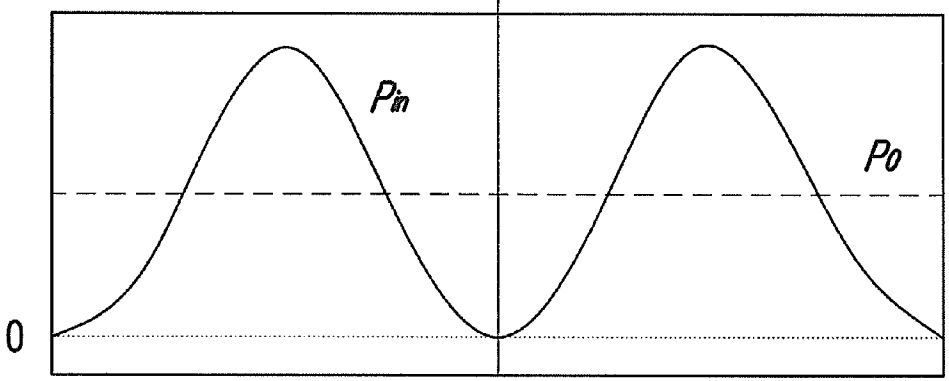
FIG. 2B(RELATED ART)
FIG. 2B is a diagram showing an input power and an output power with a traditional AC power.

In the following, the depicted embodiments together with the included drawings are intended to explain the feasibility of the present invention.

Reference will now be made in detail to the present preferred embodiments of the invention, examples of which are illustrated in the accompanying drawings. Wherever possible, the same reference numbers are used in the drawings and the description to refer to the same or like parts.

Figure 3:
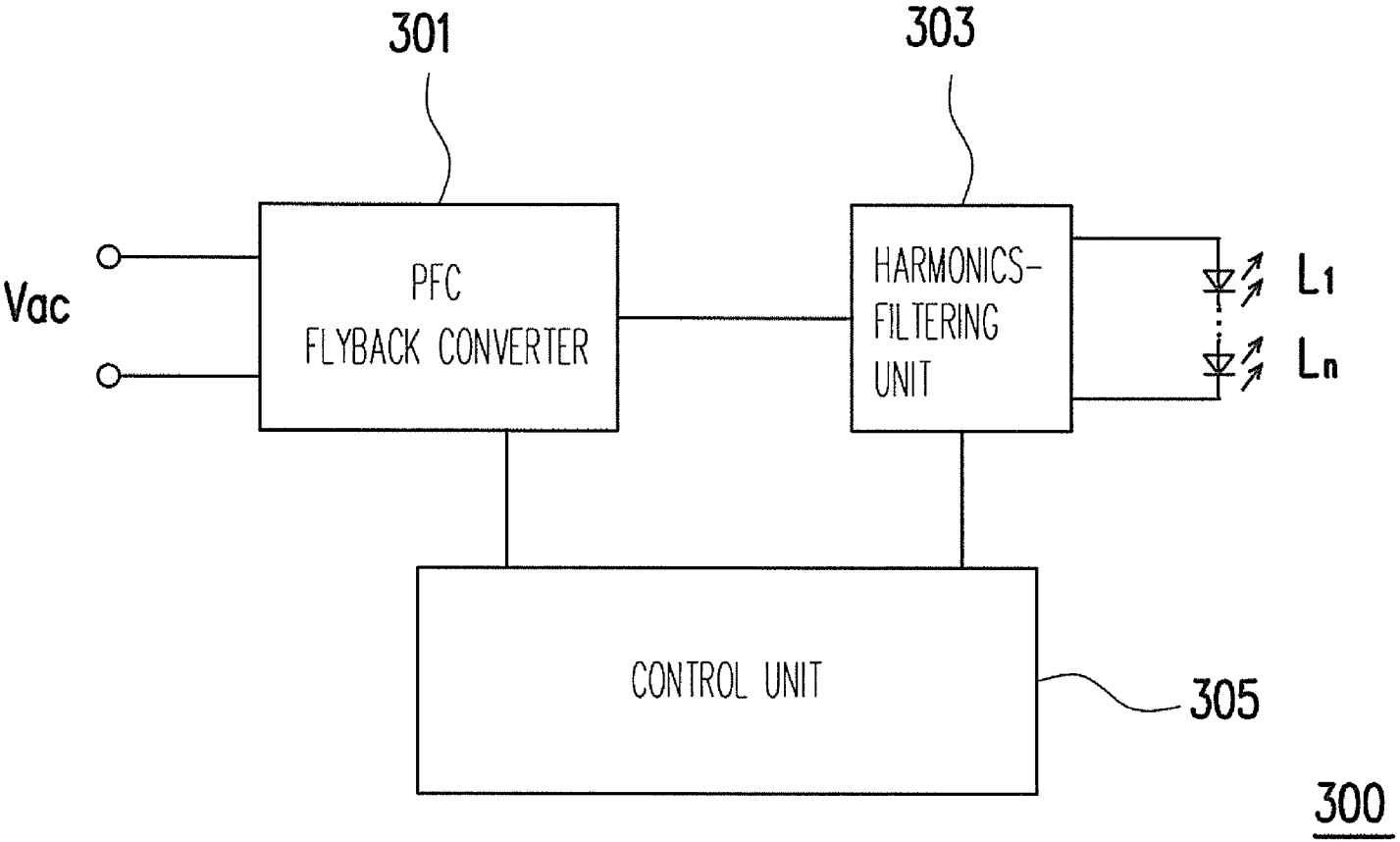
FIG. 3 is a block chart of a driving apparatus according to an embodiment of the present invention.
Figure 4:
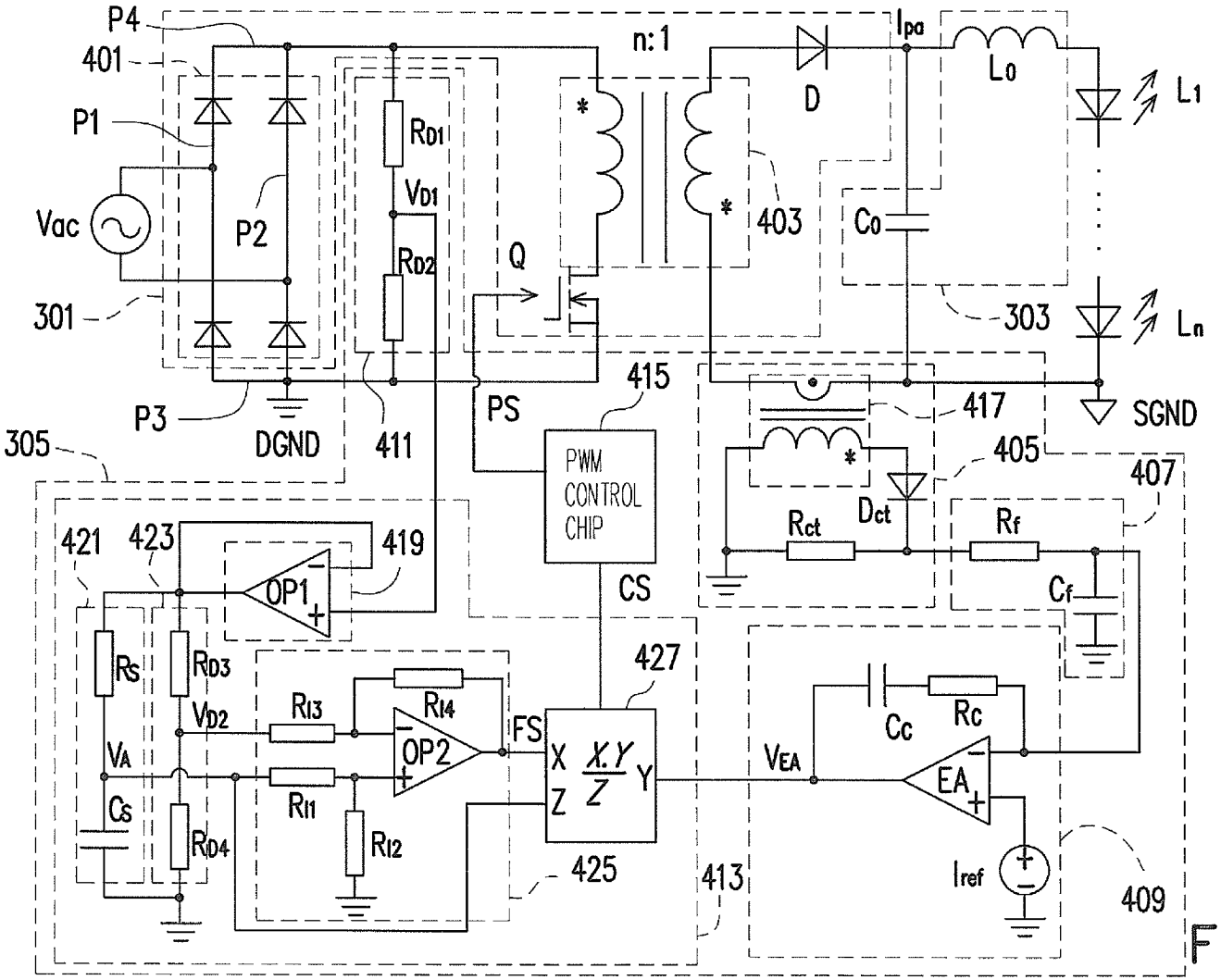
FIG. 4 is an implemented circuit diagram of a driving apparatus according to an embodiment of the present invention.

FIG. 3 is a block chart of a driving apparatus 300 according to an embodiment of the present invention and FIG. 4 is an implemented circuit diagram of the driving apparatus 300 according to an embodiment of the present invention. Referring to FIGS. 3 and 4, a driving apparatus 300 is suitable for driving at least a string of light emitting diodes (LEDs) with large power L1-Ln, wherein the plurality of LEDs are connected to each other in series. The driving apparatus 300 includes a power factor correction (PFC) flyback converter 301, a harmonics-filtering unit 303 and a control unit 305. The flyback PFC converter 301 works in a discontinuous current mode (DCM) according to a pulse-width modulation (PWM) signal PS and receives an AC power Vac (i.e., commercial AC voltage) so as to convert the AC power Vac into a pulsating current Ipa.

The harmonics-filtering unit 303 is coupled to the flyback PFC converter 301 and the string of LEDs $L_1$-$L_n$ for receiving the pulsating current Ipa and filtering out the high-frequency harmonic components in the pulsating current Ipa so as to drive the string of LEDs $L_1$-$L_n$. The control unit 305 is coupled to the flyback PFC converter 301 and the harmonics-filtering unit 303 and produces the PWM signal PS according to the AC power Vac and the pulsating current Ipa and reduces the peak-to-average ratio (PAR) of the pulsating current Ipa.

In the embodiment, the flyback PFC converter 301 includes a full-bridge rectifier 401, a transformer 403, a switch Q and a diode D. The full-bridge rectifier 401 receives the AC power Vac and conducts a rectifying on the AC power Vac. The full-bridge rectifier 401 is designed to have four pins P1-P4, wherein the pins P1 and P2 receive the AC power Vac and the pin P3 is coupled to a dangerous ground DGND. The first end of the primary side of the transformer 403 is coupled to the pin P4 of the full-bridge rectifier 401. The control terminal of the switch Q receives the PWM signal PS, the first terminal of the switch Q is coupled to the second end of the primary side of the transformer 403 and the second terminal of the switch Q is coupled to the dangerous ground DGND. The anode of the diode D is coupled to the first end of the secondary side of the transformer 403, and the cathode of the diode D outputs the pulsating current Ipa.

The harmonics-filtering unit 303 includes an inductor Lo and a film capacitor Co. The first end of the inductor Lo is coupled to the cathode of the diode D and the second end of the inductor Lo is coupled to the anode of the string of LEDs $L_1$-$L_n$ (i.e. the anode of the LED $L_1$). The first terminal of the film capacitor Co is coupled to the cathode of the diode D and the second terminal of the film capacitor Co is coupled to the cathode of the string of LEDs $L_1$-$L_n$ (i.e. the cathode of the LED $L_n$) and a safety ground SGND. In this regard, any ground belonging to the primary side of the transformer 403 is identified as the dangerous ground DGND, and any ground belonging to the secondary side of the transformer 403 is identified as the safety ground SGND.

It should be noted that since the luminous flux of the string of LEDs $L_1$-$L_n$ (i.e., the output light power) depends on the average value of the pulsating current Ipa only and is not related to the frequency thereof, so that the luminous flux of the string of LEDs $L_1$-$L_n$ can be precisely controlled by properly controlling the average value of the pulsating current Ipa. Although the luminous flux of the string of LEDs $L_1$-$L_n$ has no relation with the frequency of the pulsating current Ipa, but the frequency of the pulsating current Ipa must be higher than the frequency of the persistence of human eye's vision; if not, human eyes would sense flashing. The persistence duration of human eye's vision is usually 1/24 second (i.e., 24 Hz), which suggests the frequency of the pulsating current Ipa must be greater than 24 Hz, for example, it is 100 Hz, which the present invention is not limited thereto.

As depiction above, in the embodiment, the flyback PFC converter 301 is defined to work in DCM mode, which is based on the consideration that only the working in the DCM mode can make the flyback PFC converter 301 automatically implement PFC and it is further avoided to make the diode D at the secondary side of the transformer 403 have backward recovery. It should be also noted that the reason for the embodiment to employ the flyback PFC converter 301 rests in that the LED itself has the semiconductor characteristic (i.e., during the LED is conductive, the voltage between the two terminals is equal to the conductive voltage drop thereof) so that the load of the flyback PFC converter 301 can be treated as a constant-voltage source. At the time, the secondary side of the transformer 403 does not need an output filter capacitor. In other words, the electrolytic capacitor in the prior art can be saved, which greatly lengthens the lifetime of the AC-DC driver of the LEDs $L_1$-$L_n$.

In addition, if the pulsating current Ipa output from the secondary side of the transformer 403 is directly used to drive the LEDs $L_1$-$L_n$, the LEDs $L_1$-$L_n$ are likely damaged due to an excessive peak value of the pulsating current Ipa. Therefore, in the embodiment, not only the average value of the pulsating current Ipa is a significant design parameter, but also it is significant to ensure the peak value of the pulsating current Ipa not damaging the LEDs $L_1$-$L_n$. In fact, as the first step, the average value of the pulsating current Ipa is controlled to ensure the flyback PFC converter 301 working normally; then, the less the peak value and the effective value of the pulsating current Ipa, the better the working condition of the LEDs is.

In order to reach the above-mentioned preferable working condition of the LEDs, the embodiment further employs an inductor Lo (its inductance is, for example, 15-30 μH, which the present invention is not limited thereto) in the path of the LEDs $L_1$-$L_n$. Meanwhile, a film capacitor Co is employed and connected in parallel to the secondary side of the transformer 403 (its capacitance is, for example, 0.47 μF-3 μF, which the present invention is not limited thereto) so as to filter out the high-frequency harmonic components caused by the frequency of the switch Q (i.e., the frequency of the PWM signal PS) in the pulsating current Ipa. As a result, the peak value of the pulsating current Ipa is reduced, and accordingly, the pulsating current Ipa has a waveform substantially near to an ideal sine square waveform.

In order to more effectively reduce the PAR of the pulsating current Ipa, the present embodiment further specially employs a control unit 305. The control unit 305 herein has two effects: during the AC power Vac is rising, the duty ratio of the PWM signal PS is reduced; during the AC power Vac is descending, the duty ratio of the PWM signal PS is increased. In this way, the PAR of the pulsating current Ipa is reduced.

In more details, the control unit 305 includes a current transformer unit 405, a low-pass filter 407, an error-adjusting circuit 409, a voltage-divider 411, a feedforward control unit 413 and a pulse-width modulation control chip 415. The current transformer unit 405 is coupled to the flyback PFC converter 301 and the harmonics-filtering unit 303 for detecting the pulsating current Ipa, i.e., for detecting the current flowing through the diode D. In the embodiment, the current transformer unit 405 includes a current transformer 417, a diode Dct and a resistor Rct. The first end of the primary side of the current transformer 417 is coupled to the second end of the secondary side of the transformer 403 and the second end of the primary side of the current transformer 417 is coupled to the second terminal of the film capacitor Co. The anode of the diode Dct is coupled to the first end of the secondary side of the current transformer 417. The first end of the resistor Rct is coupled to the cathode of the diode Dct and the second end of the resistor Rct is coupled to the second end of the secondary side of the current transformer 417 and the dangerous ground DGND.

The low-pass filter 407 is coupled to the current transformer unit 405 for conducting an average processing on the pulsating current Ipa detected by the current transformer 405 so as to take an average value of the pulsating current Ipa. In the embodiment, the low-pass filter 407 includes a resistor Rf and a capacitor Cf. The first end of the resistor Rf is coupled to the cathode of the diode Dct. The first terminal of the capacitor Cf is coupled to the second end of the resistor Rf and the second terminal of the capacitor Cf is coupled to the dangerous ground DGND.

The error-adjusting circuit 409 is coupled to the low-pass filter 407 for conducting an error adjusting on the pulsating current Ipa and a reference current Iref so as to output an error adjusting signal $V_{EA}$, wherein the average value of the pulsating current Ipa has been taken already. In the embodiment, the error-adjusting circuit 409 includes an error amplifier EA, a resistor Rc and a capacitor Cc. The negative input terminal of the error amplifier EA is coupled to the first terminal of the capacitor Cc, the positive input terminal of the error amplifier EA is for receiving the reference current Iref and the output terminal of the error amplifier EA is for outputting the error adjusting signal $V_{EA}$. The first end of the resistor Rc is coupled to the negative input terminal of the error amplifier EA, the first terminal of the capacitor Cc is coupled to the second end of the resistor Rc and the second terminal of the capacitor Cc is coupled to the output terminal of the error amplifier EA.

The voltage-divider 411 is coupled between the pin P3 and the pin P4 of the full-bridge rectifier 401 for sampling the AC power Vac after being rectified by the full-bridge rectifier 401 and then producing a voltage-dividing signal $V_{D1}$. In the embodiment, the voltage-divider 411 includes two resistors $R_{D1}$ and $R_{D2}$. The first end of the resistor $R_{D1}$ is coupled to the pin P4 of the full-bridge rectifier 401; the second end of the resistor $R_{D1}$ is for producing the voltage-dividing signal $V_{D1}$; the first end of the resistor $R_{D2}$ is coupled to the second end the resistor $R_{D1}$; the second end the resistor $R_{D2}$ is coupled to the dangerous ground DGND.

The feedforward control unit 413 is coupled to the error-adjusting circuit 409 and the voltage-divider 411 for receiving the error adjusting signal $V_{EA}$ and the voltage-dividing signal $V_{D1}$ and thereby producing a control signal CS. Thus, the pulse-width modulation control chip 415 (for example but not limited thereto, chip UCC3844 manufactured by TI Co.) coupled to the feedforward control unit 413 would receive the control signal CS and thereby produce the PWM signal PS so as to control the operation of the switch Q, i.e., to control the switch Q for conducting or cutting-off.

In the embodiment, the feedforward control unit 413 includes an emitter follower 419, a signal-keeping unit 421, a voltage-divider 423, a subtracting circuit 425 and a multiplying-dividing circuit 427. The emitter follower 419 is for receiving and outputting the voltage-dividing signal $V_{D1}$. In more details, the emitter follower 419 includes an operational amplifier OP1, wherein the positive input terminal of the operational amplifier OP1 is coupled to the second end of the resistor $R_{D1}$ and the negative input terminal and the output terminal of the operational amplifier OP1 are coupled to each other so as to output the voltage-dividing signal $V_{D1}$.

The signal-keeping unit 421 is coupled to the emitter follower 419 for receiving the voltage-dividing signal $V_{D1}$ output from the emitter follower 419 and then producing an amplitude-detecting signal VA (which is proportional to the peak value of the AC power Vac). In more details, the signal-keeping unit 421 includes a resistor Rs and a capacitor Cs. The first end of the resistor Rs is coupled to the output terminal of the operation amplifier OP1, the second end of the resistor Rs is for producing the amplitude-detecting signal VA, the first terminal of the capacitor Cs is coupled to the second end of the resistor Rs and the second terminal of the capacitor Cs is coupled to the dangerous ground DGND.

The voltage-divider 423 is coupled to the emitter follower 419 for receiving the voltage-dividing signal $V_{D1}$ output from the emitter follower 419 and thereby producing another voltage-dividing signal $V_{D2}$ (which is, for example but not limited thereto, 0.6 VA |sin ω t|). In more details, the voltage-divider 423 includes two resistors $R_{D3}$ and $R_{D4}$. The first end of the resistor $R_{D3}$ is coupled to the output terminal of the operation amplifier OP1; the second end of the resistor $R_{D3}$ is for producing the voltage-dividing signal $V_{D2}$; the first end of the resistor $R_{D4}$ is coupled to the second end the resistor $R_{D3}$; the second end the resistor $R_{D4}$ is coupled to the dangerous ground DGND.

The subtracting circuit 425 is coupled to the signal-keeping unit 421 and the voltage-divider 423 for receiving the amplitude-detecting signal VA and the voltage-dividing signal $V_{D2}$ and conducting a subtracting operation on the amplitude-detecting signal VA and the voltage-dividing signal $V_{D2}$. After that, the subtracting circuit 425 outputs a feedforward signal FS. In more details, the subtracting circuit 425 includes four resistors $R_{I1}$-$R_{I4}$ and an operation amplifier OP2. The first end of the resistor $R_{I1}$ is coupled to the second end of the resistor $R_S$. The first end of the resistor $R_{I2}$ is coupled to the second end of the resistor $R_{I1}$. The second end of the resistor $R_{I2}$ is coupled to the dangerous ground DGND. The positive input terminal of the operation amplifier OP2 is coupled to the first end of the resistor $R_{I2}$ and the output terminal of the operation amplifier OP2 is for outputting the feedforward signal FS. The first end of the resistor $R_{I3}$ is coupled to the second end of the resistor $R_{D3}$. The second end of the resistor $R_{I3}$ is coupled to the negative input terminal of the operation amplifier OP2. The first end of the resistor $R_{I4}$ is coupled to the second end of the resistor $R_{I3}$ and the second end of the resistor $R_{I4}$ is coupled to the output terminal of the operation amplifier OP2.

The multiplying-dividing circuit 427 is coupled to the error-adjusting circuit 409, the pulse-width modulation control chip 415, the signal-keeping unit 421 and the subtraction circuit 425 for receiving the feedforward signal FS, the amplitude-detecting signal VA and the error adjusting signal $V_{EA}$, multiplying the feedforward signal FS by the error adjusting signal $V_{EA}$, followed by dividing the multiplying result by the amplitude-detecting signal VA so as to output the control signal CS, i.e. CS=(FS*VEA)/VA.

Based on the depiction above, since the LED itself has the the semiconductor characteristic (i.e., during the LED is conductive, the voltage between the two terminals is equal to the conductive voltage drop thereof) so that the load of the flyback PFC converter 301 can be treated as a constant-voltage source. At the time, the secondary side of the transformer 403 does not need an output filter capacitor. In other words, the electrolytic capacitor in the prior art can be saved, which greatly lengthens the lifetime of the AC-DC driver for the LEDs $L_1$-$L_n$.

On the other hand, the embodiment employs the inductor Lo and the film capacitor Co to filter out the high-frequency harmonic components caused by the frequency of the switch Q (i.e., the frequency of the PWM signal PS) in the pulsating current Ipa. As a result, the input current of the AC power Vac would fully track the input voltage thereof (i.e. the input current and the input voltage have the same phase), which leads the harmonic components of the input current of the AC power Vac very small and the IPF to be higher than 0.9, even approaching 1.

It should be noted that the embodiment takes the above-mentioned scheme wherein the control unit 305 is used to reduce the duty ratio of the PWM signal PS during the AC power Vac is rising and to increase the duty ratio of the PWM signal PS during the AC power Vac is descending, so that the PAR of the pulsating current Ipa output from the flyback PFC converter 301 is substantially largely reduced (reduced roughly to 1.4, which the present invention is not limited thereto). In this way, the embodiment ensures the peak value of the pulsating current Ipa not too high and thus avoids the LEDs $L_1$-$L_n$ from being damaged.

Figure 5:
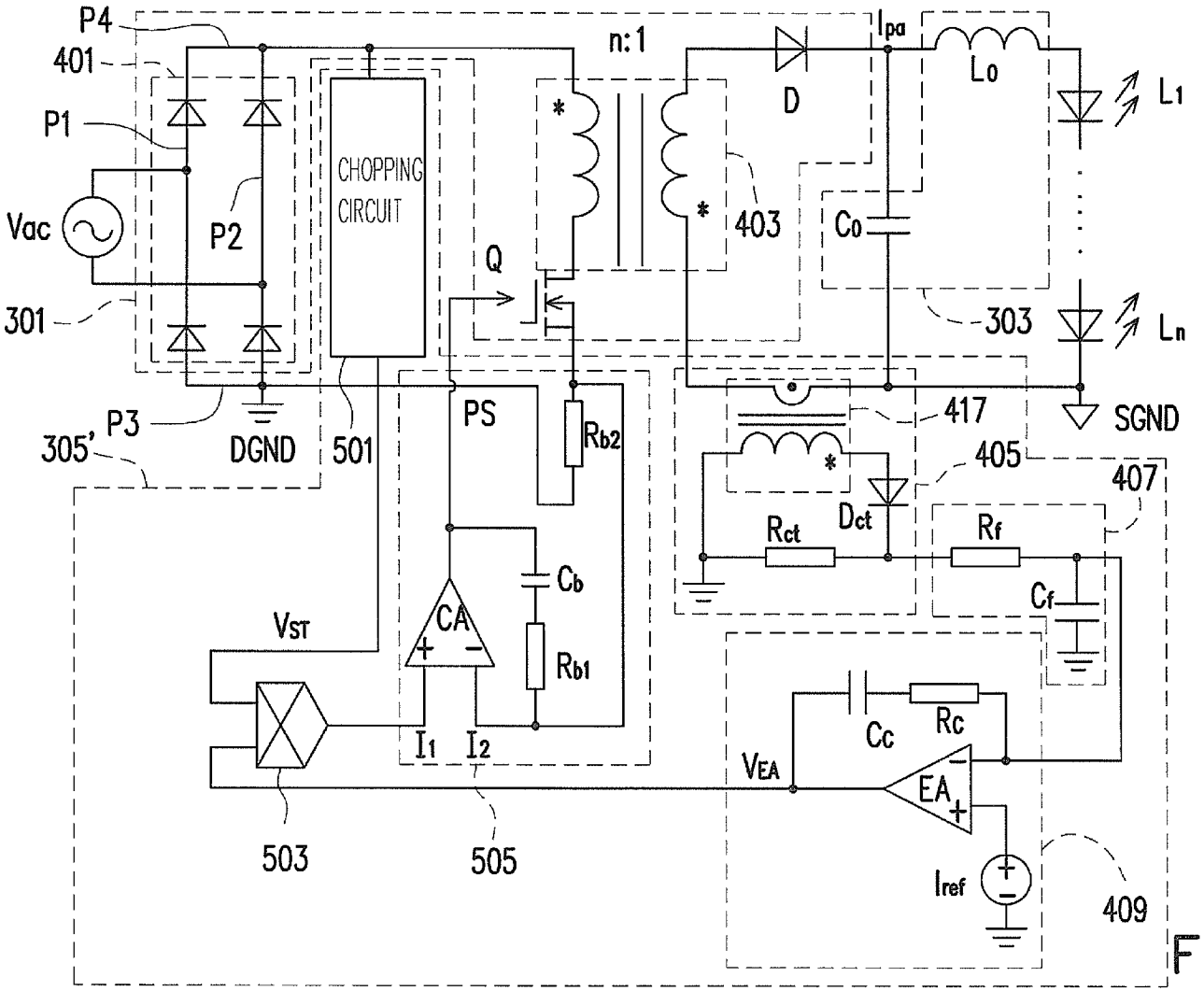
FIG. 5 is an implemented circuit diagram of a driving apparatus according to another embodiment of the present invention.

FIG. 5 is an implemented circuit diagram of a driving apparatus according to another embodiment of the present invention. Referring to FIGS. 4 and 5, it can be seen from FIG. 5 the driving apparatus 500 is different from the driving apparatus 300. In the driving apparatus 500, the control unit 305' adopts a chopping circuit 501 with quite simple circuit structure, a multiplier 503 and a current-adjusting circuit 505 to replace the feedforward control unit 413 and the pulse-width modulation control chip 415 in the control unit 305 of the driving apparatus 300 in FIG. 4. Moreover, the flyback PFC converter 301 of the driving apparatus 500 works in BCM.

Figure 6:
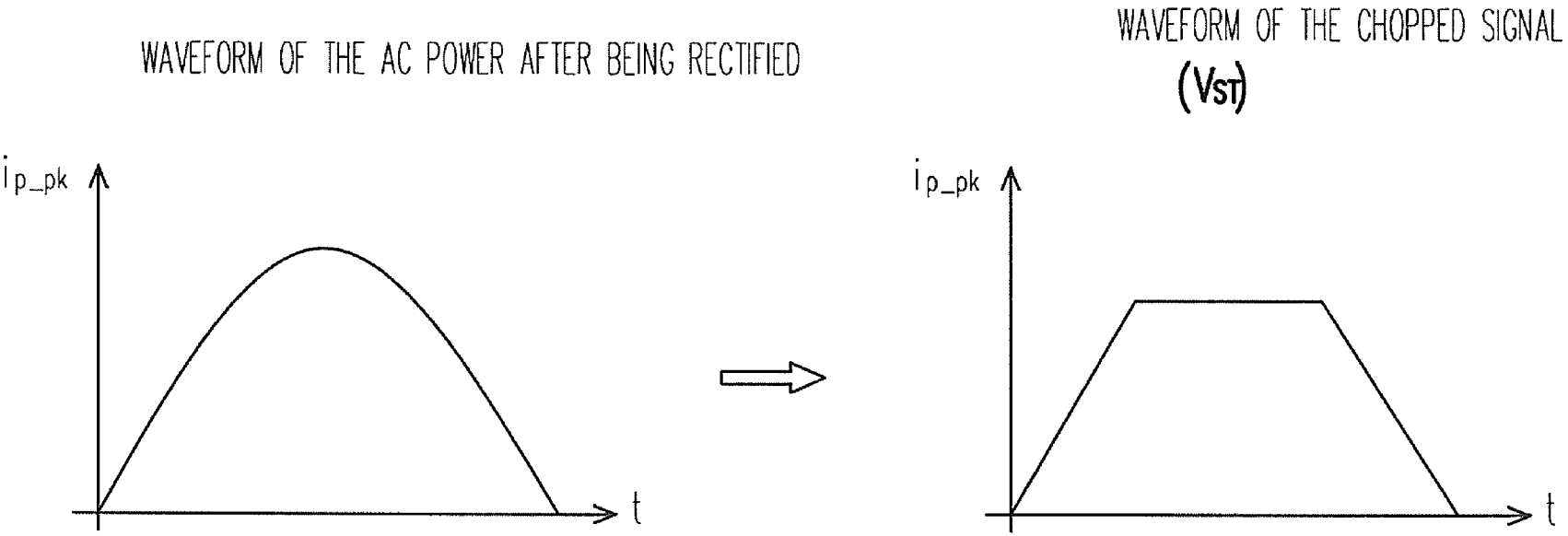
FIG. 6 is a waveform diagram showing an AC power signal after being rectified and a chopped signal according to an embodiment of the present invention.

In the embodiment, the chopping circuit 501 is for receiving the AC power Vac after being rectified by the full-bridge rectifier 401 and conducting a chopping processing on the received AC power Vac (as shown in FIG. 6) so as to produce a chopped signal $V_{ST}$. The multiplier 503 is coupled to the chopping circuit 501 and the error-adjusting circuit 409 for receiving the chopped signal $V_{ST}$ and the error adjusting signal $V_{EA}$ and thereby producing a first current $I_1$. The current-adjusting circuit 505 is coupled to the multiplier 503 and the switch Q for conducting a current adjusting on the first current $I_1$ and a second current $I_2$ flowing through the switch Q so as to output the PWM signal PS.

Figure 7:
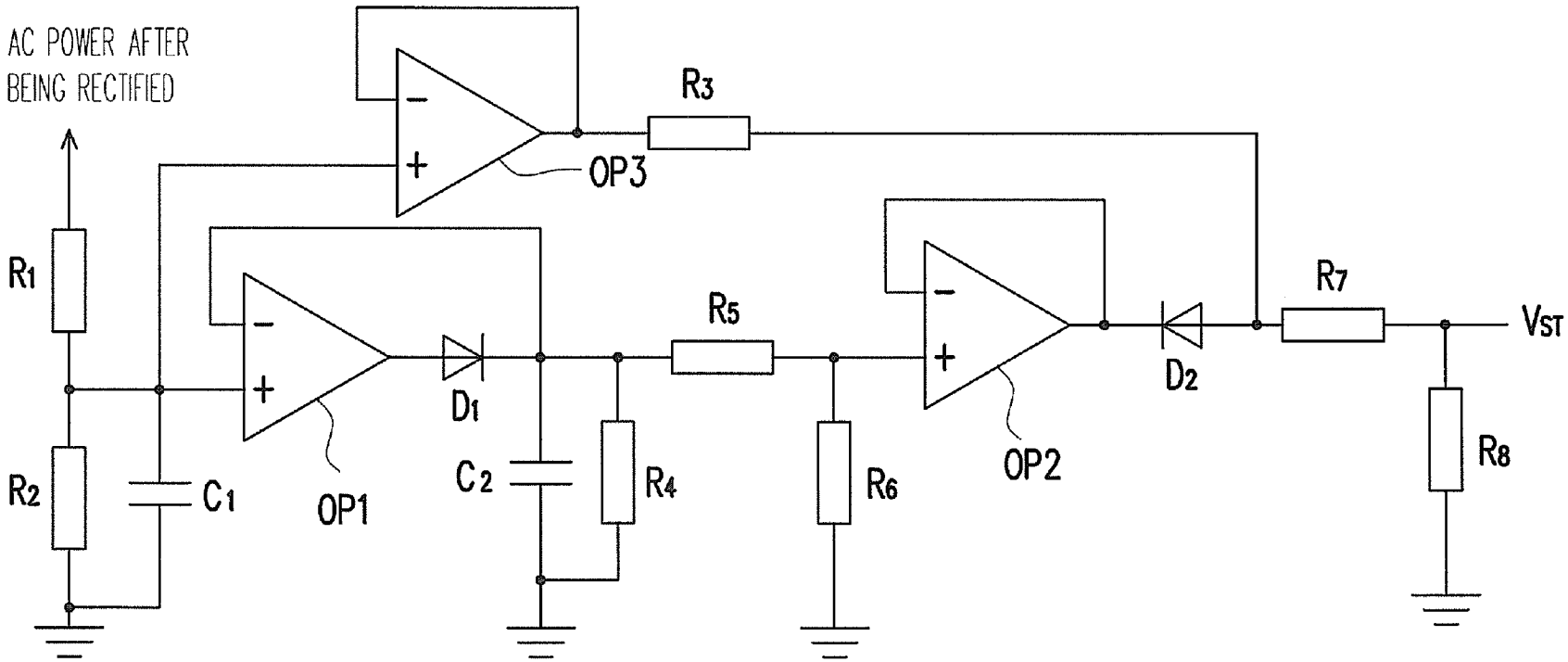
FIG. 7 is an implemented circuit diagram of a chopping circuit according to an embodiment of the present invention.

In addition, the implemented design diagram of the chopping circuit 501 can refer, for example, FIG. 7, which the present invention is not limited thereto. The chopping circuit 501 includes eight resistors $R_1$-$R_8$, two capacitors $C_1$ and $C_2$, two diodes $D_1$ and $D_2$ and three operation amplifiers OP1, OP2 and OP3, wherein the first end of the resistor $R_1$ is for receiving the AC power Vac after being rectified by the full-bridge rectifier 401, the resistor $R_2$ is coupled between the second end of the resistor $R_1$ and the dangerous ground DGND. The capacitor $C_1$ is coupled to two ends of the resistor $R_2$. The positive input terminal (+) of the operation amplifier OP1 is coupled to the second end of the resistor $R_1$ and the positive input terminal (+) of the operation amplifier OP3. The negative input terminal (−) of the operation amplifier OP1 is coupled to the cathode of the diode $D_1$, the first ends of the resistors $R_4$ and $R_5$ are coupled to the first terminal of the capacitor $C_2$. The output terminal of the operation amplifier OP1 is coupled to the anode of the diode $D_1$.

The negative input terminal (−) of the operation amplifier OP3 is coupled to the output terminal thereof and the first end of the resistor $R_3$. The second end of the resistor $R_4$ and the second terminal of the capacitor $C_2$ are coupled to the dangerous ground DGND. The second end of the resistor $R_5$ is coupled to the first end of the resistor $R_6$ and the positive input terminal (+) of the operation amplifier OP2. The second end of the resistor $R_6$ is coupled to the dangerous ground DGND. The negative input terminal (−) of the operation amplifier OP2 is coupled to the output terminal thereof and the cathode of the diode $D_2$. The anode of the diode $D_2$ is coupled to the second end of the resistor $R_3$ and the first end of the resistor $R_7$. The second end of the resistor $R_7$ is coupled to the first end of the resistor $R_8$ for outputting the chopped signal $V_{ST}$, while the second end of the resistor $R_8$ is coupled to the dangerous ground DGND.

On the other hand, the current-adjusting circuit 505 includes a current amplifier CA, two resistors $R_{b1}$ and $R_{b2}$ and a capacitor $C_b$, wherein the positive input terminal (+) of the current amplifier CA is for receiving the first current $I_1$, and the negative input terminal (−) of the current amplifier CA is for receiving the second current $I_2$. The first end of the resistor $R_{b1}$ is coupled to the negative input terminal (−) of the current amplifier CA and the second end of the resistor $R_{b1}$ is coupled to the first terminal of the capacitor $C_b$. The second terminal of the capacitor $C_b$ is coupled to the output terminal of the current amplifier CA and the control terminal of the switch Q. The first end of the resistor $R_{b1}$ is coupled to the second terminal of the switch Q and the first end of the resistor $R_{b1}$, and the second end of the resistor $R_{b1}$ is coupled to the dangerous ground DGND.

It can be seen from the driving apparatus 500 in FIG. 5 that in order to simplify the implemented circuit of the control unit 305 of the last embodiment and reduce the cost, the present embodiment avoids employing the feedforward control unit 413 and the pulse-width modulation control chip 415, both which are employed in the control unit 305 of the last embodiment purposely for reach the above-mentioned goal. Different from the last embodiment, where the feedforward control unit 413 and the pulse-width modulation control chip 415 are employed to produce specific odd harmonics introduced in the circuit (for example, the $3^{rd}$, $5^{th}$, $7^{th}$ . . . odd harmonics), in the present embodiment, a simpler chopping circuit 501 is employed for conducting a chopping processing on the waveform of the AC power Vac after being rectified, and the chopped waveform is used as the base waveform of the input current (i.e., the waveform at the control terminal of the switch Q). In this way, the present embodiment not only reaches the almost same effect as the last embodiment, but also has a simpler implemented circuit.

In summary, the driving apparatus provided by the present invention is suitable for driving LEDs with AC input, high power factor and long lifetime, wherein a pulsating current is used to drive the LEDs and the electrolytic capacitor in the traditional LED AC-DC driver circuit is eliminated, which greatly increase the lifetime of the LED AC-DC driver. On the other hand, in addition to meeting the power factor requirement specified by the Energy-Star standard, the driving apparatus provided by the present invention is able to optimize the waveform of the pulsating current used to driving the LEDs by means of the harmonics-filtering unit and the control unit, and the optimized waveform would greatly reduce the PAR of the pulsating current output by the flyback PFC converter. In this way, the high power LEDs can stably, safely and durably work without affecting the operation lifetime of the LEDs.

On the other hand, the driving apparatus provided by the present invention is able to provide the LEDs' load with the optimized pulsating current so as to make the LEDs safely and stably work with the rated power, because the driving apparatus employs a flyback PFC converter and a series connection inductor, and the PFC converter takes a scheme to control the average value of the pulsating current by feeding back the input voltage. Meanwhile, in comparison with the conventional LEDs AC-DC driver, the novel AC-DC driver for high power LEDs provided by the present invention does not employ the electrolytic capacitor, so that the present invention greatly increases the operation lifetime thereof and more suits driving high power LEDs.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims and their equivalents. In addition, any one of the embodiments or claims of the present invention is not necessarily achieve all of the above-mentioned objectives, advantages or features.

What is claimed is:

1. A driving apparatus, suitable to drive at least a string of light emitting diodes, the driving apparatus comprising:

a flyback power factor correction converter, for working in an operation mode according to a pulse-width modulation signal, and receiving an alternating current power and converting the alternating current power into a pulsating current;

a harmonics-filtering unit, coupled to the flyback power factor correction converter and the string of light emitting diodes, for receiving the pulsating current and filtering out high-frequency harmonic components in the pulsating current so as to drive the string of light emitting diodes; and a control unit, coupled to the flyback power factor correction converter and the harmonics-filtering unit, for detecting the pulsating current by a means of current-transforming, and producing the pulse-width modulation signal according to the alternating current power and the detected pulsating current, wherein the control unit is further for reducing the peak-to-average ratio of the pulsating current by adjusting a duty cycle of the pulse-width modulation signal in response to a variation of the alternating current power.

2. The driving apparatus as claimed in claim 1, wherein the flyback power factor correction converter comprises:

a full-bridge rectifier, for receiving the alternating current power and conducting a rectifying on the alternating current power;

a transformer, wherein a primary side of the transformer receives the alternating current power after being rectified by the full-bridge rectifier;

a switch, controlled by the pulse-width modulation signal and connected in series to the primary side of the transformer; and a diode, coupled to a secondary side of the transformer and outputting the pulsating current.

3. The driving apparatus as claimed in claim 2, wherein the harmonics-filtering unit is composed by an inductor and a film capacitor.

4. The driving apparatus as claimed in claim 3, wherein the control unit comprises:

a current transformer unit, coupled to the flyback power factor correction converter and the harmonics-filtering unit, for detecting the pulsating current;

a low-pass filter, coupled to the current transformer unit, for taking an average value of the pulsating current detected by the current transformer unit; and an error-adjusting circuit, coupled to the low-pass filter, for conducting an error adjusting on the pulsating current after taking the average value thereof and a reference current so as to output an error adjusting signal.

5. The driving apparatus as claimed in claim 4, wherein the control unit further comprises:

a first voltage-divider, for sampling the alternating current power after being rectified by the full-bridge rectifier so as to produce a first voltage-dividing signal;

a feedforward control unit, coupled to the error-adjusting circuit and the first voltage-divider, for receiving the error adjusting signal and the first voltage-dividing signal and thereby producing a control signal; and a pulse-width modulation control chip, coupled to the feedforward control unit, for receiving the control signal and thereby producing the pulse-width modulation signal.

6. The driving apparatus as claimed in claim 5, wherein the operation mode is a discontinuous current mode.

7. The driving apparatus as claimed in claim 5, wherein the feedforward control unit comprises:

an emitter follower, for receiving and outputting the first voltage-dividing signal;

a signal-keeping unit, coupled to the emitter follower, for receiving the first voltage-dividing signal output from the emitter follower and thereby producing an amplitude-detecting signal;

a second voltage-divider, coupled to the emitter follower, for receiving the first voltage-dividing signal output from the emitter follower and thereby producing a second voltage-dividing signal;

a subtraction circuit, coupled to the signal-keeping unit and the second voltage-divider, for receiving the amplitude-detecting signal and the second voltage-dividing signal, and conducting a subtracting operation on the amplitude-detecting signal and the second voltage-dividing signal and then outputting a feedforward signal; and a multiplying-dividing circuit, coupled to the error-adjusting circuit, the pulse-width modulation control chip, the signal-keeping unit and the subtraction circuit, for receiving the feedforward signal, the amplitude-detecting signal and the error adjusting signal, and multiplying the feedforward signal by the error adjusting signal, then dividing the multiplied result by the amplitude-detecting signal so as to output the control signal.

8. The driving apparatus as claimed in claim 4, wherein the control unit further comprises:

a chopping circuit, for receiving the alternating current power after being rectified by the full-bridge rectifier and conducting a chopping processing on the received alternating current power so as to produce a chopped signal;

a multiplier, coupled to the chopping circuit and the error-adjusting circuit, for receiving the chopped signal and the error adjusting signal so as to produce a first current; and a current-adjusting circuit, coupled to the multiplier and the switch, for conducting a current adjusting on the first current and a second current flowing through the switch so as to output the pulse-width modulation signal.

9. The driving apparatus as claimed in claim 8, wherein the operation mode is a boundary conduction mode.

* * * * *